US011686133B2

(12) United States Patent
Couto Maquieira et al.

(10) Patent No.: US 11,686,133 B2
(45) Date of Patent: Jun. 27, 2023

(54) OPENING CONTROL WITH MECHANICAL LIFT-UP

(71) Applicant: AKWEL VIGO SPAIN SL, Vigo Pontevedra (ES)

(72) Inventors: Delmiro Javier Couto Maquieira, Pontevedra (ES); Alberto Diez Estevez, Pontevedra (ES); Javier Casal Gomez, Vigo (ES); Jose Oscar Vazquez Carballo, Vigo (ES); Julio Garcia Rodriguez, Pontevedra (ES)

(73) Assignee: AKWEL VIGO SPAIN SL, Vigo Pontevedra (ES)

( * ) Notice: Subject to any disclaimer, the term of this patent is extended or adjusted under 35 U.S.C. 154(b) by 238 days.

(21) Appl. No.: 16/710,308

(22) Filed: Dec. 11, 2019

(65) Prior Publication Data

US 2020/0199919 A1 Jun. 25, 2020

(30) Foreign Application Priority Data

Dec. 20, 2018 (FR) ..... 18/73619

(51) Int. Cl.

| | |
|---|---|
| ***E05B 85/10*** | (2014.01) |
| ***E05B 85/16*** | (2014.01) |
| ***E05B 81/90*** | (2014.01) |
| *E05B 85/14* | (2014.01) |

(52) U.S. Cl.

CPC ..... *E05B 85/107* (2013.01); *E05B 81/90* (2013.01); *E05B 85/103* (2013.01); *E05B 85/16* (2013.01); *E05B 85/14* (2013.01)

(58) Field of Classification Search

CPC ..... E05B 85/107; E05B 85/103; E05B 85/16; E05B 81/90; E05B 85/10; E05B 5/00; E05B 5/003; E05B 5/006

See application file for complete search history.

(56) References Cited

U.S. PATENT DOCUMENTS

| | | | | |
|---|---|---|---|---|
| 7,621,573 | B2 * | 11/2009 | Thomas | E05B 81/76 292/336.3 |
| 9,080,352 | B2 * | 7/2015 | Aerts | E05B 85/18 |
| 10,435,926 | B2 * | 10/2019 | Brown | E05B 85/16 |
| 10,731,389 | B2 * | 8/2020 | Smart | E05B 85/107 |

(Continued)

FOREIGN PATENT DOCUMENTS

| | | |
|---|---|---|
| FR | 3 026 131 A1 | 3/2016 |
| GB | 2536672 A | 9/2016 |

(Continued)

*Primary Examiner* — Kristina R Fulton
*Assistant Examiner* — Emily G. Brown
(74) *Attorney, Agent, or Firm* — Oliff PLC

(57) ABSTRACT

The opening control includes a handle pivotally mounted on a support prone to adopt a pushed position, an intermediate rest position and an ejected position as well as electrical and mechanical means for driving in movement the handle and coupled with the handle of the vehicle such that the application of a predefined force on the handle causes the mechanical or electrical activation. It includes a hard point crossing means configured to define a pattern of evolution of a value of a force applied on the handle as a function of a push-in stroke of the handle between its rest position and the pushed position, including a crossing of a hard point separating first and second portions of the stroke.

10 Claims, 6 Drawing Sheets

(56) References Cited

U.S. PATENT DOCUMENTS

| | | | | |
|---|---|---|---|---|
| 10,815,702 | B2 * | 10/2020 | Yoshino | E05B 81/76 |
| 2017/0130493 | A1 * | 5/2017 | Guerin | E05B 85/16 |
| 2017/0260780 | A1 * | 9/2017 | Christensen | E05B 81/77 |
| 2018/0148957 | A1 * | 5/2018 | Och | E05B 85/107 |
| 2018/0171686 | A1 * | 6/2018 | Couto Maquieira | E05B 85/107 |
| 2019/0211592 | A1 * | 7/2019 | Bextermoller | E05B 85/107 |
| 2019/0234117 | A1 * | 8/2019 | Bextermoller | E05B 81/76 |
| 2021/0156179 | A1 * | 5/2021 | Savant | E05B 85/107 |

FOREIGN PATENT DOCUMENTS

| | | | | |
|---|---|---|---|---|
| WO | WO-2019002469 | A1 * | 1/2019 | E05B 85/107 |
| WO | 2019/091899 | A1 | 5/2019 | |
| WO | WO-2019091899 | A1 * | 5/2019 | E05B 81/40 |

* cited by examiner

[Fig. 1]
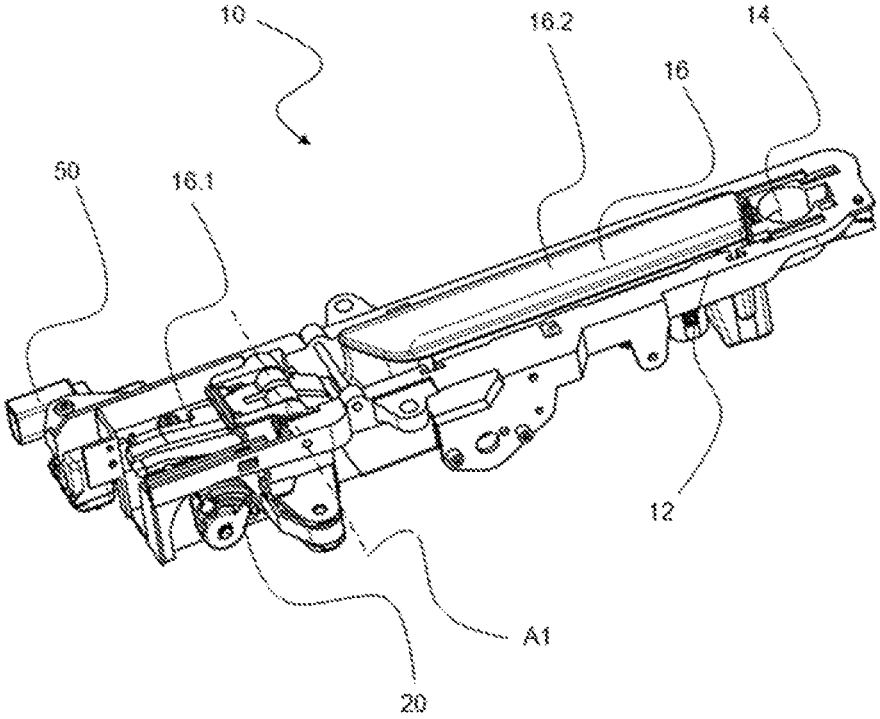

[Fig. 2]
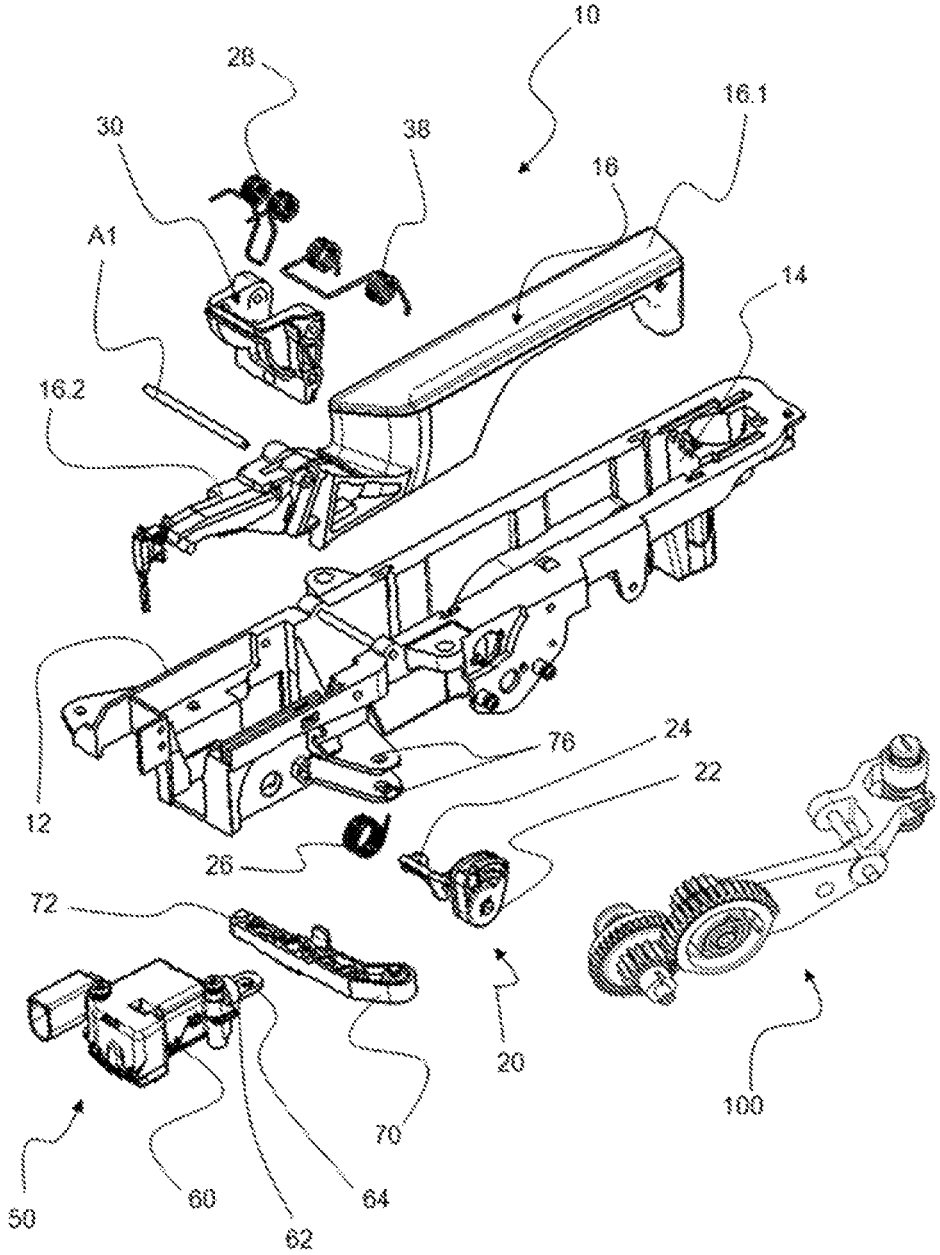

[Fig. 3]
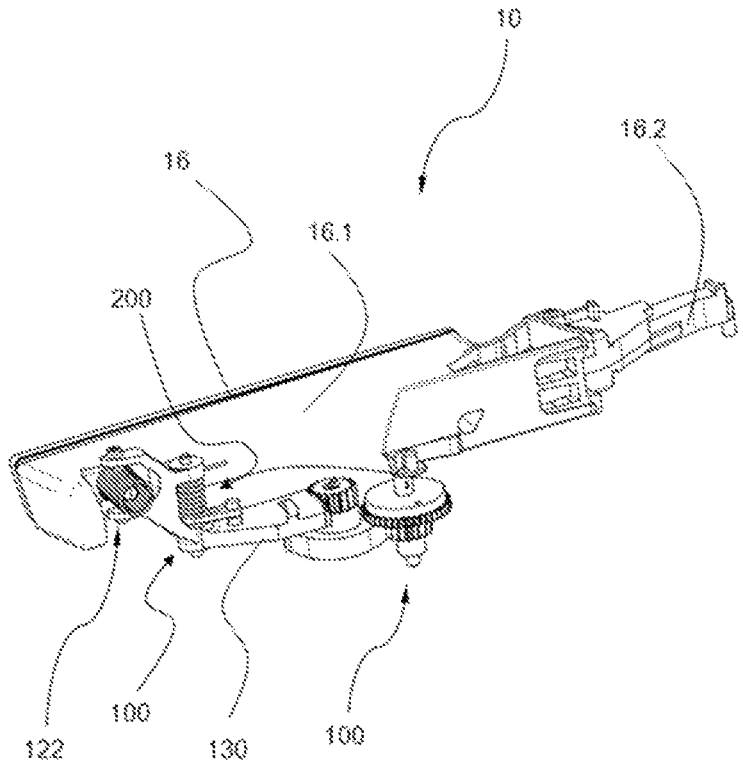
[Fig. 4]
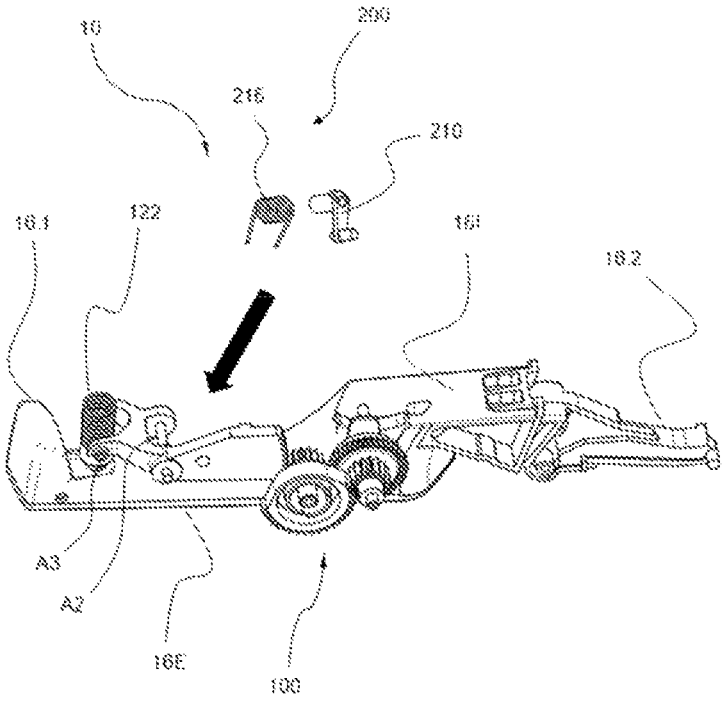

[Fig. 5]
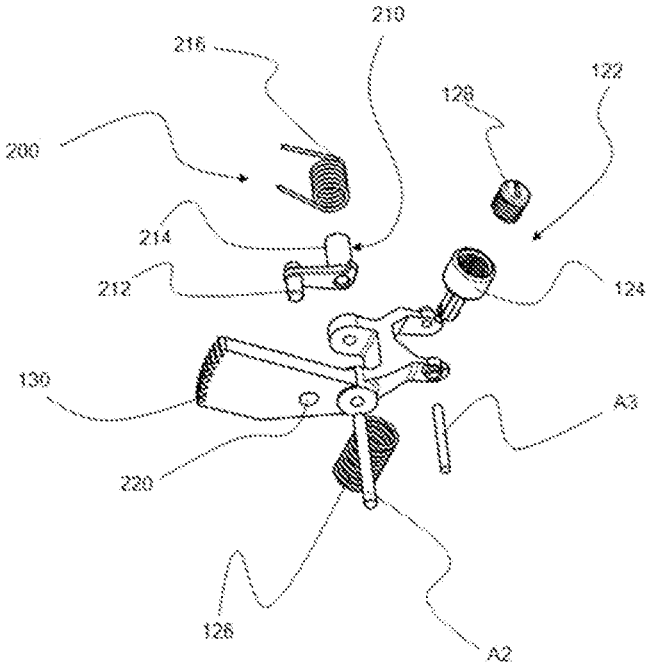
[Fig. 6]
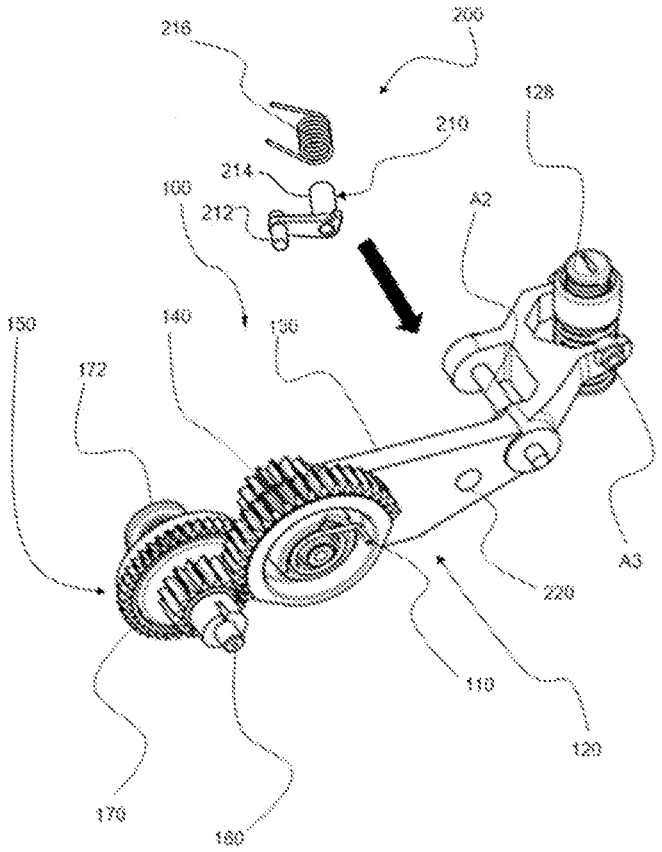

[Fig. 7]
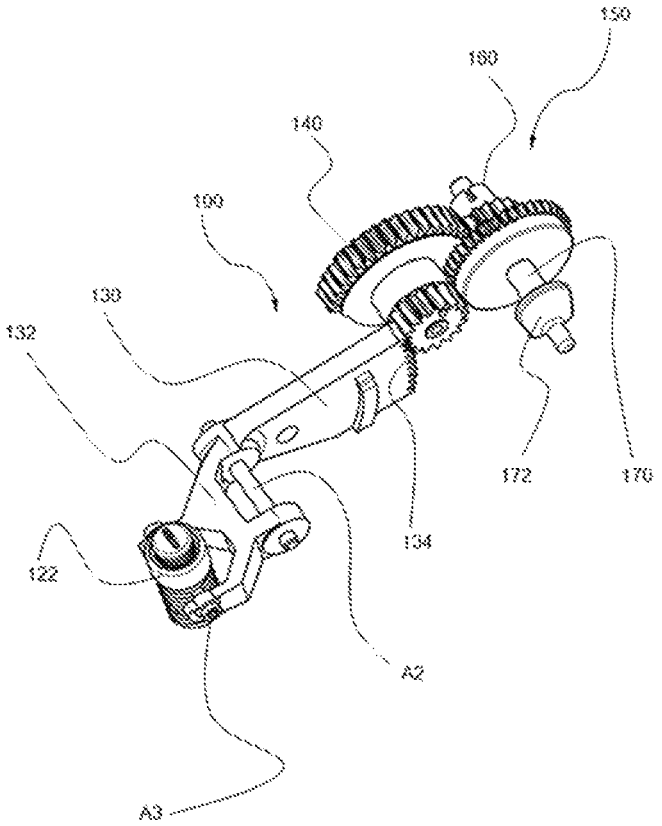
[Fig. 8]
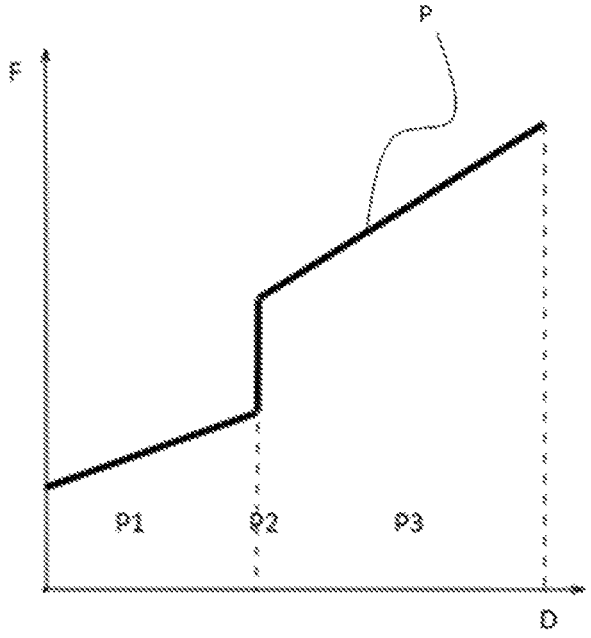

[Fig. 9]
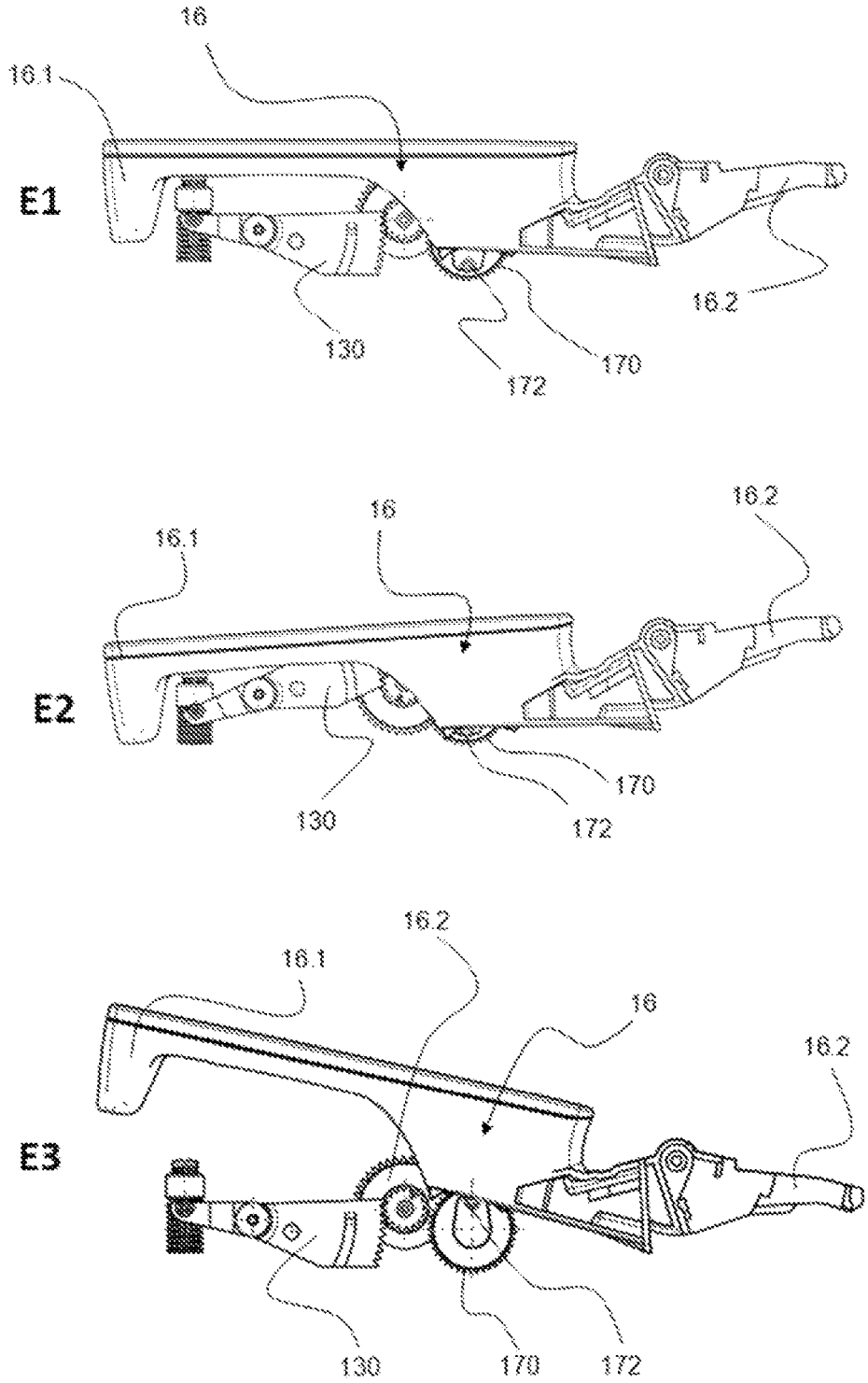

OPENING CONTROL WITH MECHANICAL LIFT-UP

TECHNICAL FIELD

The present invention concerns an opening control for a motor vehicle door leaf. More particularly but not exclusively, the invention concerns an external opening control which comprises backup mechanical unlocking means for the event of failure of the electrical actuation means of the opening control. This opening control applies to an unlocking with both a conventional latch or an electrically actuated latch, also known as «electronic latch» or «e-latch».

In general, an external opening control comprises a fixed support intended to be mounted on the door leaf and a handle movably mounted on the support, for example pivotally mounted by being rotatably hinged about an axis secured to the support.

The opening control also comprises an unlocking mechanism, which, when the handle is pulled, enables the unlocking the latch and thus the opening of the door. The latch conventionally comprises a pin secured to the door adapted to cooperate with a striker secured to the bodywork. During the opening of the door from outside the vehicle, the pin is cleared from the striker by actuation of the external opening control.

More particularly, the invention concerns an opening control with a «flush» type handle, that is to say that the support on which the handle is movably mounted forms a cavity adapted to receive the handle in the retracted configuration. In this retracted configuration, the external surface of the handle is flush with the external surface of the external wall of the door leaf. In the extended or deployed configuration, the handle comes out at least partially from the cavity of the support so as to be able to be grasped by a user of the vehicle in order to open the door. For this purpose, the user can displace the handle further outwards in order to control the latch of the door. In general, the opening control comprises a mechanism for electrically ejecting the handle to enable the handling of the handle by the user and the opening of the door leaf. The electrical ejection mechanism operates from an electric power supply delivered for example by a battery of the motor vehicle and may be electronically controlled remotely thanks to a key, a mobile phone or any other device enabling a remote communication.

Nonetheless, in case of failure of this electric power supply, the electrically ejected handle cannot be used and the user cannot access to the vehicle. Hence, it is necessary to provide a backup mechanism allowing unlocking the door of the vehicle in particular when the battery has not enough energy for the electrical ejection mechanism to operate.

PRIOR ART

The backup mechanism enabling the ejection of the handle is generally unleashed in case of failure of the electric power supply and by activation of a specific control member borne by the door leaf of the motor vehicle.

The invention aims in particular at proposing a means for actuating the backup mechanical ejection of the handle in case of electric failure of the electric power supply which is intuitive, robust and easy to use.

SUMMARY OF THE INVENTION

To this end, an object of the invention is an opening control for a motor vehicle door leaf of the type comprising:

a handle pivotally mounted on a support prone to adopt a pushed position, an intermediate rest position and an ejected position, a first electrical activation means and a second mechanical activation means for driving in movement the handle between its pushed position up to its ejected position through the rest position, the first and second means being coupled with the handle of the vehicle such that the application of a predefined force on the handle causes said mechanical or electrical activation, characterized in that it comprises a hard point crossing means configured to define a pattern of evolution of a value of a force applied on the handle as a function of a push-in stroke of the handle between its rest position and the pushed position, comprising a crossing of a hard point separating first and second portions of the stroke and in that the first electrical activation means is configured to be unleashed in the first portion of the stroke and the second mechanical activation means is configured to be unleashed in the second portion of the stroke after crossing of the hard point.

Thanks to the invention, the user can intuitively unleash the backup mechanism in order to cause the ejection of the handle and thus open the door leaf of the motor vehicle. Moreover, with the presence of the hard point, the passage from an electrically-assisted configuration to a manual configuration is easily recognizable by the user.

An opening control according to the invention may further include the following features.

In another embodiment of the invention, the second mechanical means comprises a mechanical energy accumulator member configured to be reloaded with energy by pushing in the handle.

In another embodiment of the invention, the control comprises a lever for transmitting the push-in force from the handle to the second mechanical means, the hard point crossing means being coupled to the transmission lever so as to decouple the movement of the handle and of the transmission lever over the first portion of the stroke and, on the contrary, couple it over the second portion of the stroke.

In another embodiment of the invention, the transmission lever is provided with an orifice and the hard point crossing means comprises a stud projecting inside the orifice and being displaceable throughout the orifice from an upper rest position in which it is elastically biased to a lower active position for coupling in rotation with the transmission lever.

In another embodiment of the invention, the hard point crossing means comprises a member pivoting about a hinge axis provided with the stud and carried by the transmission lever and a member for elastically biasing the pivoting member.

In another embodiment of the invention, the orifice has an oblong general shape.

In another embodiment of the invention, the transmission lever comprises a main body provided with the orifice and comprising a forked end portion supporting the hinge axis of the pivoting member.

In another embodiment of the invention, the transmission lever has a circular sector shape pivotally linked to a member for stopping the push-in of the handle and forming at the other end a toothed gear circular arc.

In another embodiment of the invention, the forked end also supports a hinge axis of the stop member.

In another embodiment of the invention, the control comprises a micro-switch or a probe configured to be actuated in the first portion of the stroke.

BRIEF DESCRIPTION OF THE DRAWINGS

Other features and advantages of the invention will appear in light of the following description, made with reference to the appended drawings in which:

FIG. 1 is a perspective view of an opening control for a motor vehicle door leaf according to the invention;

FIG. 2 is an exploded perspective view of the opening control of FIG. 1;

FIG. 3 is a bottom perspective view of the opening control of FIG. 1 and of a hard point crossing means;

FIG. 4 is a bottom perspective view of the opening control of FIG. 3 in which the hard point crossing means is in a dismounted state;

FIG. 5 is an exploded view of the hard point crossing means of FIG. 3 intended to be mounted on the opening control;

FIG. 6 is an enlarged exploded perspective view of a drive mechanism of FIG. 4;

FIG. 7 is a perspective view of the drive mechanism viewed from the bottom on which the hard point crossing means is mounted;

FIG. 8 is a curve representing the evolution of the magnitude of a push-in force of the handle as a function of the push-in stroke of the handle;

FIG. 9 illustrates three operating states of the opening control according to the invention: a first rest state E1, a second state E2 during push-in and a third state E3 of releasing the handle.

DESCRIPTION OF THE EMBODIMENTS

In FIG. 1, there is represented an opening control for a motor vehicle door leaf according to a preferred embodiment of the invention. This opening control is referred to by the general reference numeral 10.

For example, the opening control 10 is intended to be mounted on an external panel (not represented) of the bodywork of a door leaf which is for example a vehicle side door.

In this example, the opening control 10 mainly includes a fixed support or case 12 having a cavity 14 for receiving a handle and a handle 16 movably mounted inside the cavity 14. In service, the support 12 is intended to be fastened to the door leaf. In the described example, the handle 16 is hingedly mounted relative to the panel, about a geometric pivot axis A1, on the support 12 and extends parallel to the general plane of the external panel.

In the illustrated example, the support 12 has a parallelepiped general shape and is adapted to be housed within a cutout or a recess of the external panel of the door leaf such that its external face is flush with the surface of the external panel of the door leaf. Preferably, the support 12 is moreover open on the side of its external face and delimits the cavity 14 intended to house the handle 16.

In the described example, the handle 6 has an outer portion 16.1 that the user can grasp. Opposite to the outer portion 16.1, the handle 16 has an inner portion 16.2 which is intended to extend inside the housing 14 of the case or support 12 as shown in FIG. 1 or 2.

In the described example, the handle 16 is of the «flush» type, that is to say that the support 12 on which the handle 16 is movably mounted delimits a cavity 14 adapted to receive the handle 16 in a retracted configuration. Preferably, in this retracted configuration, the external surface of the handle 16 is flush with the external surface of the external wall of the door leaf. In the extended or deployed configuration, the handle 16 extends at least partially from the cavity 14 of the support 12 so as to be able to be grasped by a user of the vehicle in order to open the door. For this purpose, for example, the user can pull the handle 16 further outwards in order to control the latch of the door. In an intermediate flush rest position, the external surface of the handle 16 coincides with the external surface of the door leaf. This «flush» arrangement, known in the automotive industry, allows enhancing the style of the vehicle and reduces the aerodynamic drag.

Nonetheless, it should be understood that other movable mountings may be considered, such as in particular by pivoting about an axis located at another position or else by translating along a direction essentially perpendicular to the midplane of the door. It should also be noted that the movable mounting of the handle relative to the support is known per so to those skilled in the art.

Preferably, the opening control 10 is intended to cooperate with a latch (not represented) of the door leaf of the motor vehicle prone to adopt a locked configuration and an unlocked configuration. Conventionally, the pivoting of the handle 16 about its hinge axis A1 actuates the latch in either one of its two locked or unlocked configuration via a drive kinematic chain (not represented in the figures). To this end, as illustrated in FIG. 1 and in FIG. 2, the opening control 10 preferably comprises a counter lever 20. In the described example, this counter lever 20 comprises a rotary cage 22 and a counter shaft 24 as well as a counter return spring 26 intended to be housed inside the rotary cage 22. For example, the rotary cage 22 comprises a means for retaining an end of a Bowden cable (not represented). The set 20 is intended to be mounted on the support 12 as illustrated in FIG. 1.

In accordance with the invention, the opening control 10 comprise a first electrical activation means 50 and a second mechanical activation means 100 for driving in movement the handle 16 between a pushed position up to an ejected position through an intermediate rest position, in this example an intermediate flush position. The first 50 and second 100 means are coupled with the handle 16 of the vehicle such that the application of a predefined push-in force on the handle 16 causes said mechanical or electrical activation.

In the example illustrated in FIG. 1, the opening control 10 comprises a first electrical activation means 50 enabling an electrical actuation of the ejection and/or of the retraction of the handle 16. For example, the opening control 10 comprises a micro-switch or a probe (not represented in the figures) which, under the effect of a slight pushing of the handle 16, is activated to control an electric actuator and thus eject the handle 16.

An embodiment of a first electrical activation means 50 is illustrated in more detail in particular with reference to FIG. 2. For its electrical operation, as illustrated in FIG. 2, the opening control 10 preferably also comprises a pivot lever 30 of the handle 16. For example, this pivot lever 30 is mounted on the pivot axis A1 of the handle 16. Thus, the pivot lever 30 is linked to the handle 16 by at least one common axis of rotation A1.

In this example, this pivot lever 30 has a caliper shape adapted to receive the inner branch 16.2 of the handle 16. Thus, the caliper shape is configured for example to receive throughout the engaged inner branch 16.1. Of course, other caliper shapes may be suitable yet without departing from the scope of the invention.

Preferably, the caliper 30 comprises a member 38 for elastically biasing in a rest position. The caliper 30 is configured to retain the handle 16 in its intermediate rest position in which the handle 16 is flush. In the described example, the caliper 30 comprises two lateral branches bent so as to form an «L» shape connected together at an upper end by an upper transverse bar and at a lower end by an upper transverse bar. Furthermore, in this example, the caliper 30 comprises two arcuate lateral structures connecting the lower end and the upper end of each of the lateral branches.

Preferably, the opening control 10 further comprises a biasing means 38 linked to the caliper 30. This biasing member 38 is configured to bias the caliper 30 in a biased position corresponding to the flush configuration of the handle 16. This biasing member 38 preferably comprises a caliper spring provided with two external legs and a central portion. In FIG. 2, it is shown that each of the two legs of the caliper spring 38 is fastened to a lower wall of the case 12.

In this example, the inner branch 16.2 of the handle 16 comprises a lower bearing wall against which the lower bar of the caliper 30 bears to accompany the movement of the handle 16.

In the described example, the handle 16 is also provided with a handle 16 biasing member 28 which is placed between the caliper 30 and the inner portion 16.1 of the handle 16 and which have as a common axis the axis A1. The handle 28 return spring has two legs intended to be fastened to the caliper 30 and a central portion engaged with the portion 16.2. The function of the handle 28 return spring is to compensate, through a biasing force, for a clearance existing between the inner portion 16.1 and the caliper 30.

Furthermore, in this example, the first electrical operation means 50 comprises an electric actuator 60 connected to an ejection arm 70 intended to pivotally extend transversely inside the case 12 as shown in FIG. 1. Preferably, the electric actuator 60 comprises a linear cylinder 62 provided with an end 64 cooperating with an end 72 of the ejection arm. For example, the end 64 comprises a notch and the end 72 comprises a lug extending inside the notch.

The opening control 10 also control a second mechanical activation means 100 configured to drive in movement the handle 16 between the pushed position up to the ejected position through the intermediate rest position in which, in this example, the handle 16 is flush. This second means 100 is illustrated in more detail in FIGS. 3 to 7. Thus, this second means 100 enables a mechanical actuation of an ejection and, also preferably, retraction, movement of the handle 16. Preferably, the second mechanical activation means 100 is configured to be mechanically triggered in response to a push-in action into the case 12 of the handle 16, the end of the push-in or release action being adapted to cause the unleashing of this second means 100. As illustrated in detail in FIG. 6, preferably, the second means 100 comprises at least one driving member 110 configured to accumulate mechanical energy during the push-in action of the handle 16 and to restitute the accumulated mechanical energy to the drive kinematic chain 150 after release of the handle 16.

Preferably, the driving member 110 is an elastic energy accumulator adapted to store and restitute mechanical energy. This means that an accumulator member according to the invention can receive mechanical energy and transform it for storage purposes in another form in order to transform it again and restitute it in a mechanical form. An accumulator member according to the invention may be made in different ways: it may, for example, include a spring, etc.

In the illustrated example, the driving member 110 comprises a spring adapted to accumulate mechanical energy by working about its longitudinal axis.

Preferably, the second means 100 is configured to be mechanically triggered in response to a push-in action into the case 12 of the handle 16 and in case of failure of the first electrical activation means 50.

Preferably, the second means 100 further comprises a kinematic chain 150 for driving in movement the handle 16 to automatically drive in movement the handle 16 over all or part of a travel starting from the pushed position of the handle 16 to the flush position through the ejected position. Preferably, the second means 100 is configured to drive in movement the handle 16 over the entirety of the travel.

Preferably, the kinematic chain 150 comprises a means 160 for transforming a rotary movement into an alternating movement of the handle 16. For example, the transformation means 160 comprises a drive shaft 170 rotatably mounted and provided with an eccentric 172.

In this example, the mechanism 100 further comprises a kinematic chain 120 for loading energy into the spring 110 during the push-in of the handle 16. In the described example, the loading kinematic chain 120 comprises at least one means 130 for transmitting the push-in movement from the handle 16 to the driving member 110.

Preferably, as illustrated in detail in FIG. 6, the drive kinematic chain 150 comprises at least one drive wheel 160 provided for example with a peripheral gear toothing. The function of this drive wheel 160 is to transmit to the drive kinematic chain 150 the accumulated energy of the driving member 110. To this end, the wheel 160 is coupled to the lift-up kinematic chain 120 and is preferably mounted directly or indirectly beneath the tension of the driving member 110.

Moreover, in the described example, the loading kinematic chain 120 also comprises a member 122 forming a stop to the push-in of the handle 16 and configured to impart a movement during the release of the handle 16. This member 122 forming a stop, as illustrated in detail in FIG. 5, comprises for example a tappet element 124 with a spring 126. In this example, the tappet element 124 has the general shape of a cylindrical sleeve extended at one of its ends by an axial rod around which the spring 126 is positioned and at the other one of its ends by an elastomeric stop 128.

In the illustrated example and as shown in detail in FIG. 7, the transmission means is a lever 130 pivotally mounted about an axis relative to the case 12 and has a shape of a circular sector pivotally linked at a first end 132 to the member 122 for stopping the push-in of the handle 16 and forming at a second end 134 a toothed gear circular arc.

For example, the end 132 of the transmission lever 130 preferably terminates in a fork 136 comprising two arms forming a «U» shape configured to support a transverse pivot axis A2 of the stop member 122. For example, the push-in stop member 122 is intended to come into contact with a lower face 161 of the outer portion 16.1 of the handle 16.

In this example, during the phase of pushing the handle 16 by an operator, the pivoting of the handle 16 about its axis A1 causes a displacement of the stop 122 by compression of its return spring 126. The lower end of the stop member 122 is rotatably linked to the transmission lever 130 by the axis A2, so that a displacement of the stop 122 causes the rotation of the transmission lever 130 about its axis A3 (FIG. 6).

In accordance with the invention, the opening control 10 also comprises a hard point crossing means 200 configured to define a pattern of evolution of a value of a push-in force of the handle as a function of a stroke of the handle between its intermediate flush position and its pushed position. Such a hard point crossing means 200 is illustrated in FIG. 3, in a mounted state, and in FIGS. 4 to 6 in a dismounted state.

FIG. 8 illustrates a curve representing the magnitude of the push-in force to be supplied as a function of the push-in stroke of the handle 16. It is shown in this curve that the hard point crossing means 200 defines a crossing of a hard point P2 separating first P1 and second P3 portions of the stroke (FIG. 8). Furthermore, the first electrical activation means 50 is configured to be unleashed in the first portion of the stroke P1 and the second mechanical activation means 100 is configured to be unleashed in the second portion of the stroke P2 after crossing of the hard point P3. As previously described, the opening control 10 comprises a lever 130 for transmitting the push-in force from the handle 16 to the second mechanical means 100. Preferably, the hard point crossing means 200 is coupled to the transmission lever 130 so as to decouple the movement of the handle 16 and of the transmission lever 130 over the first portion of the stroke P1 and, on the contrary, to couple it over the second portion of the stroke P3.

Preferably, the hard point crossing means 200 comprises a member 210 pivoting about a hinge axis A2 carried by the transmission lever 130 and a member 216 for elastically biasing the pivoting member 210. For example, the pivoting member 210 comprises a stud 212 (crank) movable about the hinge axis A2 and a crankpin 214 eccentric with respect to the axis A2.

In the described example, the transmission lever 130 is provided with an orifice 220 and the stud 212 is configured to project inside the orifice 220 and is displaceable throughout the orifice 220 from an upper rest position in which it is elastically biased by an elastic biasing member 216 to a lower active position for coupling in rotation with the transmission lever 130. In this example, the orifice 220 has an oblong general shape. Preferably, the stud 212 is configured to project inside the orifice 220 and being displaceable throughout the orifice 220 from an upper rest position in which it is elastically biased to a lower active position for coupling in rotation with the transmission lever 130.

Furthermore, preferably, the transmission lever 130 comprises a main body provided with the orifice 220 and comprises a forked end portion 132 supporting the hinge axis A2 of the pivoting member 210.

Preferably, in order to also support the dampening stop member 122, the transmission lever 130 comprises on the same forked end portion 132 the hinge axis A3 of the stop member 122.

The main aspects of the operation of an opening control according to the invention will now be described with reference to FIG. 9 illustrating three steps E1 to E3 of operation of the opening control 10 according to the invention.

Initially, the opening control 10 is in a rest state «E1» in which the handle 16 is in an intermediate flush position inside the case 14. In this state «E1», the stud 212 is configured to project inside the orifice 220 in an upper rest position in which it is elastically biased by the elastic biasing member 216.

At step «E2», the operator then pushes the handle 16 inside a first stroke P1 which corresponds to a covered distance. During this push-in stroke P1, the force to be exerted evenly increases with a slight slope as shown in FIG. 8. The operator does not feel any excessive force to activate the electrical means 50 and during the release of the handle 16, the handle 16 is electrically ejected. For example, during this first stroke P1, a sensor (not represented) detects the displacement of the handle 16 and triggers the activation of the first means 50.

In the electrical operating mode, for example with reference to the embodiment of FIG. 1, during the triggering of the sensor, the actuator 60 controls the extension of the cylinder 62 causing the pivoting of the ejection arm 70. The latter will push against the lower branch 36 of the ejection caliper 30 against the biasing force exerted by the return spring 38 to accompany the ejection of the handle 16.

In the case where the electrical operation turns out to be impossible because of an electric failure, the user can unleash the second mechanical activation means 100 preferably provided with an elastic energy accumulator forming the driving member by continuing pushing in the handle 16 beyond the hard point P2.

To activate the mechanical activation means 100, the operator continues pushing in the handle 16 until crossing the hard point P2. In this case, the force to be exerted increases abruptly with a steep slope and the operator noticeably feels the crossing of the hard point P2. The operator then continues pushing in the handle 16 in a second stroke P3 with a relatively slight slope and that in order to engage the reloading of the elastic energy accumulator.

This push-in action makes the handle 16 pivots about its axis A1 against its return spring 28. In its active position, against the biasing force of its spring 216, the stud 212 comes into contact with the inside of the oblong orifice 220, and preferably with the lower portion of the orifice 220. In this example, the force of the spring 216 of the pivoting member 210 is added to the force of the stop spring 122 connected to the transmission lever 130. Once the hard point crossing P2 is overpassed, the force to be exerted during the stroke P3 increases in a less significant manner, for example with a slope similar to the slope of the first portion P1 of the stroke.

Thanks to the invention, the passage from an electrical actuation mode to a mechanical actuation mode in case of failure of the electrical means 50 is done in a simple and intuitive way. Moreover, the hard point crossing means according to the invention is barely bulky and is relatively robust as it does not require complex and numerous parts.

Of course, the invention is not limited to the previously described embodiments. Other embodiments within the reach of those skilled in the art may also be considered yet without departing from the scope of the invention defined by the claims hereinafter.

The invention claimed is:

1. An opening control for a motor vehicle door leaf, the control comprising:

a handle pivotally mounted on a support and configured to adopt a pushed position, an intermediate rest position and an ejected position;

an electrical activation means and a mechanical activation means, both for driving the handle in movement between the pushed position up to the ejected position through the intermediate rest position, the electrical activation means and the mechanical activation means being coupled with the handle; and a hard point crossing means configured to define an evolution pattern of a push-in force applied on the handle as a function of a push-in stroke of the handle between the intermediate rest position and the pushed position, the evolution pattern comprising a first stroke portion, a second stroke portion and a hard point separating the first stroke portion and the second stroke portion from each other, the hard point corresponding to an abrupt increase in push-in force from the first stroke portion to the second stroke portion, so that crossing the hard point corresponds to an abrupt increase in the push-in force to be exerted to continue moving the handle over the second stroke portion;

wherein the electrical activation means is configured to be unleashed in the first stroke portion and the mechanical activation means is configured to be unleashed in the second stroke portion after crossing the hard point.

2. The control according to claim 1, wherein the mechanical activation means comprises at least one mechanical energy accumulator member configured to be reloaded with energy by pushing in the handle.

3. The control according to claim 1, comprising a transmission lever for transmitting the push-in force from the handle to the mechanical activation means, the hard point crossing means being coupled to the transmission lever so as to decouple movement of the handle and movement of the transmission lever over the first stroke portion and couple movement of the handle and movement of the transmission lever over the second stroke portion.

4. The control according to claim 3, wherein the transmission lever is provided with an orifice and the hard point crossing means comprises a stud projecting inside the orifice, the stud being displaceable throughout the orifice, from an upper rest position in which the stud is elastically biased to a lower active position for coupling in rotation with the transmission lever.

5. The control according to claim 4, wherein the hard point crossing means further comprises:

a pivoting member pivoting about a hinge axis, the pivoting member being provided with the stud and carried by the transmission lever, and an elastic biasing member for elastically biasing the pivoting member.

6. The control according to claim 4, wherein the orifice has an oblong shape.

7. The control according to claim 4, wherein the transmission lever comprises a main body provided with the orifice and comprising a forked end portion supporting a hinge axis.

8. The control according to claim 3, wherein the transmission lever has a circular sector shape pivotally linked to a stop member for stopping a push-in movement of the handle and forming a toothed gear circular arc.

9. The control according to claim 8, wherein the forked end also supports a hinge axis of the stop member.

10. The control according to claim 1, comprising a micro-switch or a probe configured to be actuated in the first stroke portion.

* * * * *